United States Patent [19]

Carlson

[11] 4,108,190

[45] Aug. 22, 1978

[54] FLUSHING TECHNIQUE AND APPARATUS FOR OUTBOARD AND STERN-DRIVE MOTORS

[76] Inventor: Gordon R. Carlson, 19 James Pl., Metuchen, N.J. 08840

[21] Appl. No.: 725,478

[22] Filed: Sep. 22, 1976

[51] Int. Cl.[2] ..... B08B 3/02; B08B 9/00

[52] U.S. Cl. ..... 134/167 R; 115/75; 285/197

[58] Field of Search ..... 285/189, 197; 134/166 R, 167 A, 137 R, 169 A; 115/0.5 HC, 17; 24/68 R, 71 ST, 74 R, 74 A, 75, 77 R, 77 A

[56] References Cited

U.S. PATENT DOCUMENTS

| | | | |
|---|---|---|---|
| 696,574 | 1/1902 | Laros | 24/71 ST |
| 2,611,631 | 9/1952 | Benson | 285/197 |
| 3,003,456 | 10/1961 | Crozier | 115/17 |
| 3,896,525 | 7/1975 | Stewart | 24/74 R |
| 3,931,828 | 1/1976 | Lawler | 115/0.5 HC |
| 4,052,953 | 10/1977 | Patel | 115/75 |

*Primary Examiner*—Trygve M. Blix
*Assistant Examiner*—D. W. Keen
*Attorney, Agent, or Firm*—Martha G. Pugh

[57] ABSTRACT

A flushing attachment comprising a resilient belt is constructed to be wrapped around and secured on the lower motor housing so that a hose fitting fastened through an opening in the belt registers with one or more water inlet ports on one side of the housing. The belt is disposed in wrap-around position to cover one or more additional water ports on the opposite side of the housing. When the motor is removed for cleansing, a garden hose is attached to the hose fitting to apply tap water to the set of water inlet ports on the one side, forcing a portion of the water into the motor and out through the cooling system. The belt is flexed in response to excess water pressure, releasing from housing ports on the opposite side that portion of the water which does not pass through the engine.

8 Claims, 13 Drawing Figures

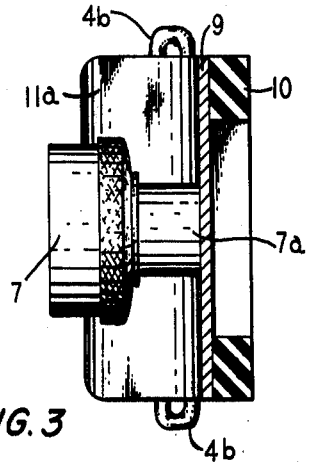
FIG. 3
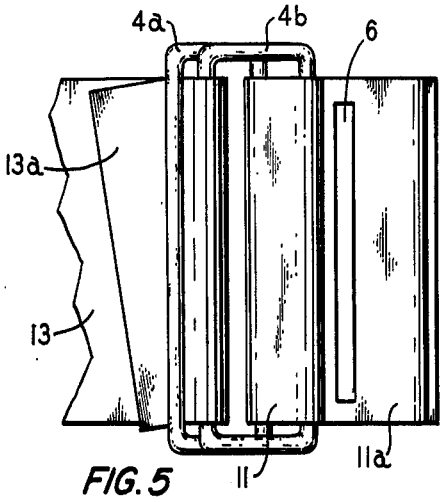
FIG. 5
FIG. 4
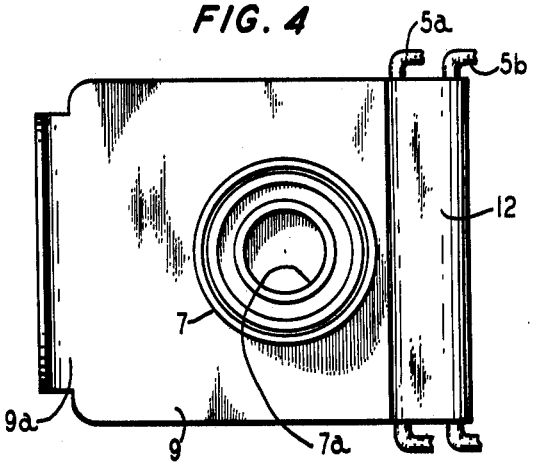
FIG. 6
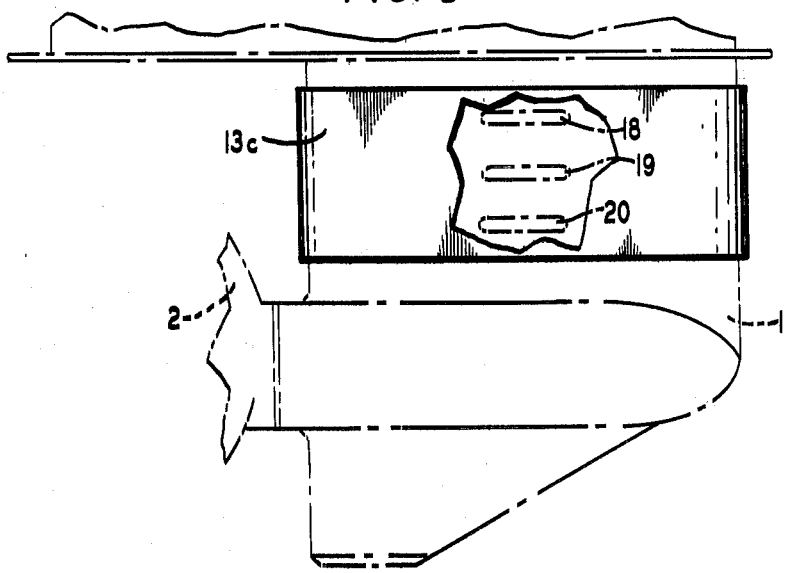

FLUSHING TECHNIQUE AND APPARATUS FOR OUTBOARD AND STERN-DRIVE MOTORS

BACKGROUND OF THE INVENTION

This relates in general to methods and apparatus for flushing and cleaning outboard or stern-drive motors.

When outboard motors are removed from the water for transportation and/or storage purposes, it is necessary to flush them out to remove debris, such as sand, silt, mud or alkalis, and, more especially, to remove traces of salt water which tend to have a corrosive effect on the engine parts.

A well-known prior art system for flushing out an outboard motor which has been removed from the water, comprises a flushing plate having a hose fitting which is adapted to be secured by screws or bolts, so that it covers water intake ports on the lower portion of the motor housing. A garden hose is connected to the fitting and the engine started, to pump tap water through the engine and out through conventional exhaust ports. One problem with a system of the type described is that the pressure of water passing through the engine may cause internal damage. Furthermore, it is inconvenient and time consuming to assemble the parts and screw them in place, and to check propeller clearance with the plate.

SUMMARY OF THE INVENTION

Accordingly, the principal object of the invention is to provide an improved system for flushing outboard and stern-drive motors which minimizes the danger of internal damage to the motor due to excess water pressure. Another object of the invention is to provide a flushing system which is simpler to install and operate than prior art systems of a similar type.

These and other objects are realized in the flushing method and apparatus of the present invention which comprises a belt of water-impervious flexible material of any elastomer, such as natural or synthetic rubber, and preferably having a scored or textured under surface, designed to be wrapped around the lower motor housing, which in many models includes a narrow waist formed between the anticavitation plate and the lower gear housing. The belt is disposed to cover the water inlet ports on both sides of the housing, and is provided with an opening which includes a hose fitting adapted to register with the inlet ports on one side when the belt is secured in wrapped-around position. The belt adheres to the face of the ports on the opposite side of the housing from the hose fitting, responding to an increase of water pressure in the housing like a valve flap which opens up to release excessive amounts of water, but closes when the water pressure is reduced.

In one embodiment, the hose fitting is substantially centered in a flushing plate of a rigid material, preferably metal, semirigid plastic or hard rubber. At the opposite edges of the flushing plate are pairs of buckles, of metal, plastic or any rigid material, which are rotatably fitted for adjustably securing the opposite ends of the belt when it is wrapped around the housing. In a modification of this embodiment, the single flushing plate is replaced by coupling members buckled to the two ends of the belt. The plate member having the hose fitting has a hooked flange near one edge, which fits into a slot in a mating flanged member buckled to the other end of the belt. The latter flange is outwardly curved to permit the members to be readily decoupled. This arrangement facilitates fastening and unfastening the device without changing the belt adjustment.

In another embodiment, the rigid flushing plate is dispensed with altogether. One end of the flexible belt is doubled back to hold a pair of wire buckels; and the hose fitting is mounted in a grommet which penetrates the double layers near the double-back edge.

For operating any of the embodiments described, after the belt is securely fastened in place so that the hose fitting registers with one of the water intake ports, a garden hose is connected to the fitting. The water from the tap is turned on and the engine is operated at a low speed.

A particular feature of the invention is that even though water coming from the hose may pass into the intake ports at high pressure, there is no danger of damaging the engine. Any excess water merely passes out of the housing through the ports on the other side, the flexible belt acting as a pressure responsive valve. Other features of the invention are its simplicity of manufacture an installation. There are no nuts and bolts which may require tools to install, and which may easily be lost. It may be fitted securely to motor housings of different shapes.

These and other objects, features and advantages of the invention will be better understood from a study of the attached drawings with reference to the description hereinafter.

BRIEF DESCRIPTION OF THE DRAWINGS

FIG. 3 is a side elevational showing of a female hose connection mounted in the flushing plate in the embodiment of FIG. 2 in its attachment in relation to the flushing plate;

FIG. 4 shows, in plan view, one member of the flushing plate coupling of FIG. 3, removed from the combination;

FIG. 5 shows, in plan view, the other member of the coupling of FIG. 3, including the slotted locking flange removed from the combination;

FIG. 6 is a showing of the belt on the side of the motor housing opposite the side shown in FIG. 1;

DETAILED DESCRIPTION

It is contemplated that the flushing system of the present invention is applicable to any of the outboard or stern-drive motors which have interconnected water intake ports spaced apart around the lower motor housing, preferably between the anticavitation plate and the gear housing. A typical motor suitable for application of the system of the present invention is Evinrude's V-4, 90 horsepower Starflight motor, although it will be understood that the system is adapted for use on any motor having an applicable structure of water ports.

Figure 1:
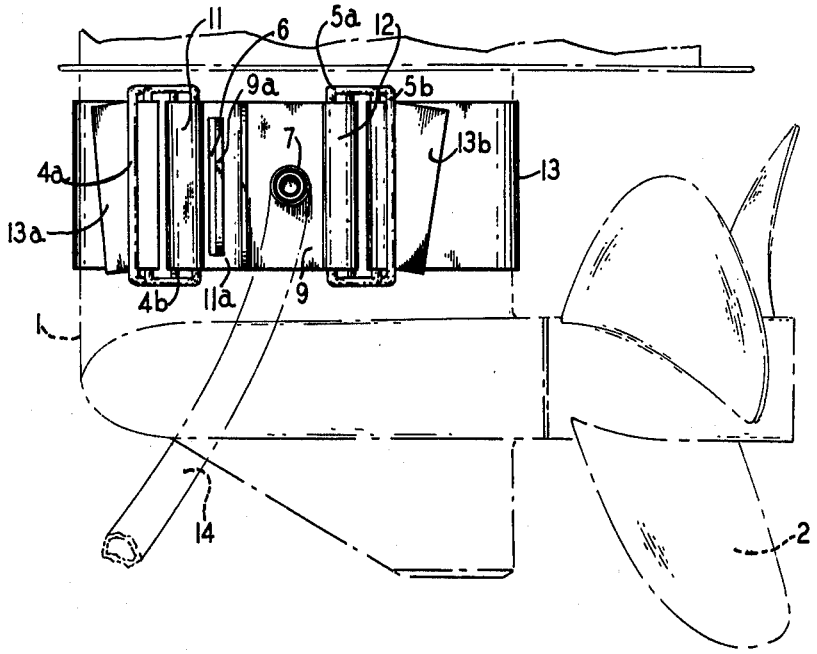
FIG. 1 of the drawings shows one embodiment of a belt assembly of the present invention, including a composite flushing and locking plate, fully assembled on the lower motor housing of a typical marine motor.
Figure 2:
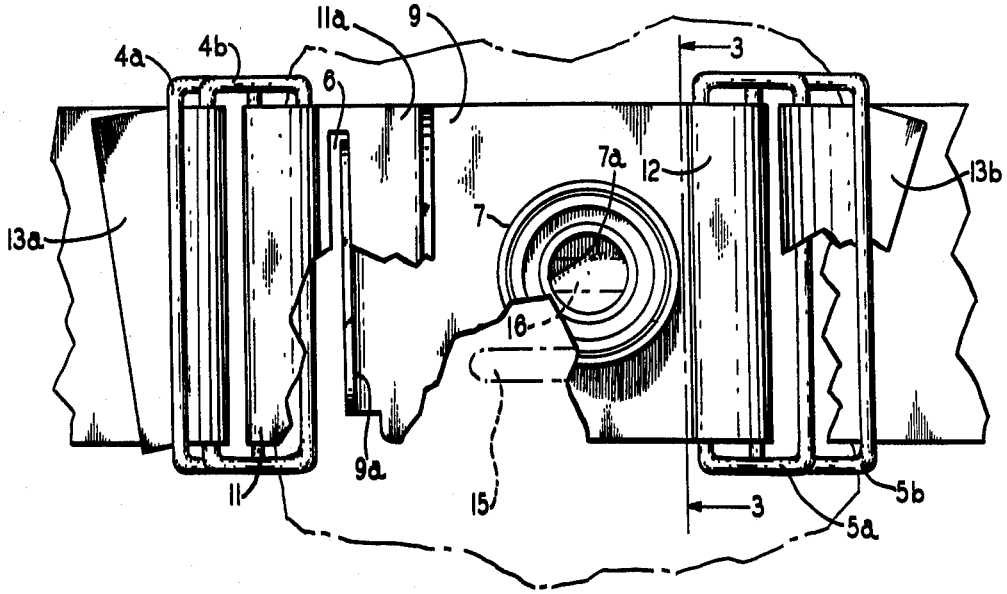
FIG. 2 is an enlarged showing, partly cut away, of the major components of the belt assembly of the embodiment of FIG. 1, in mounted relation to the lower motor housing.

Referring now to FIG. 1 of the drawings, there is shown an embodiment of the invention secured around the lower motor housing 1 which comprises a flexible belt 13 in which the flushing plate takes the form of a two-piece metal coupling, comprising flanged flushing plate member 9 and the slotted mating flange member 11a. FIG. 2 shows an enlarged view of the flushing plate members 9 and 11a in coupled relation, which are removed from the belt and shown separately in FIGS. 4 and 5.

In the present example, flushing plate 9 is of zinc plated steel, about 2 11/16 inches long and 3¼ inches wide and 1/16 inch thick. The right-hand edge is rolled over on itself to form a flattened, cylindrical buckle retainer 12, about ½ inch wide externally. The left-hand edge terminates in an outwardly directed flange 9*a*, indented ¼ inch from the upper and lower edges of plate 9, extending about ¼ inch out from the edge, and protruding about 5/16 inch from the face of plate 9. Flange 9*a* is designed to engage a matching slot 6 in coupling member 11*a*, shown in FIG. 5, which may be of similar material to plate 9.

Coupling member 11*a* is 3¼ inches wide and 1 3/16 inches in the length direction of the belt, and 1/16 inch thick, having its left-hand edge rolled over on itself to form a flattened, cylindrical buckle retainer 11, about ½ inch wide, corresponding to buckle retainer 12. Parallel with and about ⅛ inch from the inside edge of buckle retainer 11 is the slot 6, about 2 13/16 inches long and ⅛ inch wide, which is designed to accommodate flange 9*a*. An outwardly curved flange 11a extends about 7/16 inch in a horizontal plane from the inner edge of slot 6, terminating in a rounded portion which extends outwardly about ½ inch from the surface of 9, to permit the flange coupling member 11*a* to be readily lifted off of the flange 9*a* of plate 9.

Each of the buckle retainers 11 and 12 is mounted with a respective pair of rotatably disposed buckles 4*a*,4*b* and 5*a*,5*b* comprising, in the present example, zinc coated steel wires ⅛ inch in diameter, which are in the form of rectangular clasps having outer dimensions of 3 3/8 inches by ¾ inch.

The belt portion of belt assembly 13 is formed of a synthetic rubber or plastic, such as, for example, 50 durometer "fabric impression" neoprene, 1/16 inch thick, say 2¼ inches to 3¼ inches wide, and, say, 36 inches long, the roughened underface of the belt being in contact with the exterior wall of the housing. The two ends 13*a* and 13*b* of belt 13 are constructed to be threaded laterally through the two pairs of buckles 4*a*,4*b* and 5*a*,5*b*, so that the length of the belt is adjustable to fit the perimeters of different shaped housing units.

Substantially centered in plate 9 is a conventional screwthreaded female hose fitting 7, about 1⅛ inches in outer diameter, one inch in inner diameter and ⅜ inch high. This is rotatably mounted on a neck 7*a*, say ⅝ inch in outer diameter and ½ inch in inner diameter, which extends about ¼ inch out from the surface of plate 9.

When the belt assembly 13 is in place, the two ends 13*a* and 13*b* of the belt are tightly latched in buckles 4*a*,4*b* and 5*a*,5*b*, so as to hold the plate 9 and the hose neck 7a substantially centered over one of a series of three or more water inlet ports 15, 16 and 17 (the latter not shown), in lower engine housing 1. A conventional garden hose 14 is attached to the female opening 7.

As indicated in FIG. 6, when the plate 9 is in place, the central portion 13c of belt 13 hugs the opposite lateral wall of housing 1, covering a series of three additional water inlet ports 18, 19 and 20 on the opposite side of housing 1, which are conventionally interconnected internally with the ports 15, 16 and 17.

In the flushing operation, fresh water is introduced through garden hose 14 and fitting 7 and is directed through one of the openings 15, 16 and 17. Assuming that the engine is then turned on at low speed, a portion of the water passes through and flushes out the engine cooling system through a system traversed by salt water when the engine is in its natural position in the water.

In view of the fact that the hose conduit 14 is of such a size that it may introduce an excess of water into the housing 1, the gasket 10 is provided on the underside of plate 9, as shown in FIG. 3, and functions to seal against irregular surfaces which may comprise various types of lower housings. Further, due to its nature and structure, gasket 10 allows a portion of the excess water to pass out without being introduced into the cooling system of the motor. Gasket 10 is of open celled neoprene, about ⅜ inch thick, and is rectangular in form, extending in about ⅜ inch from each of the edges in the plane of plate 9, so as to form a substantially rectangular opening in which 7*a* is centered.

When belt assembly 13 is in place, and water is being introduced from one side, as described in the foregoing paragraph, the belt portion 13*c* hugs the opposite side of lower unit 1, as shown in FIG. 6. Due to the flexibility and elasticity of belt 13, it will slightly lift off of outlets 18, 19 and 20, thereby permitting a precisely controlled amount of the excess water to pass out. This is a salient feature of the invention.

It will be understood that the plate 9 need not necessarily be flat, but can be shaped so as to conform to the leading edge of the lower motor housing 1. Thus, it is contemplated that the sectional shape, looking down on the modified plate, may be, say, parabolic or of other curved form, with the hose connection being located on one of the legs of the paraboloid or corresponding form. It will be understood that other variations in the connecting plate shape are within the contemplation of the invention, which may be adapted to fit different shapes of motor housings.

Figure 7:
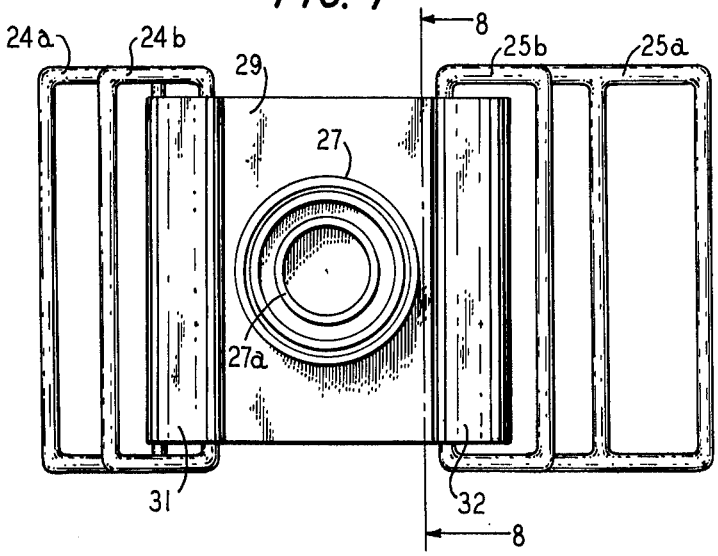
FIG. 7 shows, in plan view, a unitary modification of the flushing plate.
Figure 8:
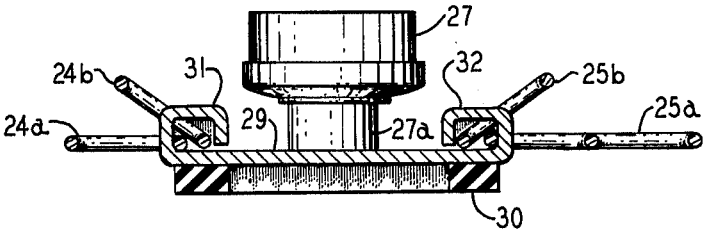
FIG. 8 is a sectional showing through the plane 8—8 of FIG. 7.
Figure 9:
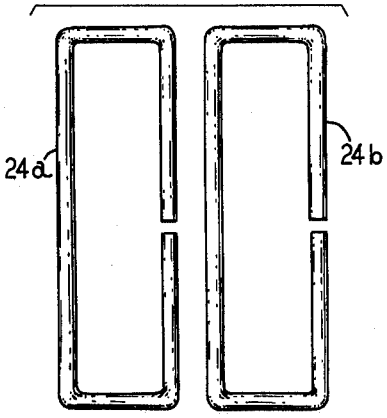
FIGS. 9 and 10 show the buckles removed from the left- and right-hand sides, respectively, of the unitary flushing plate shown in FIG. 7.
Figure 10:
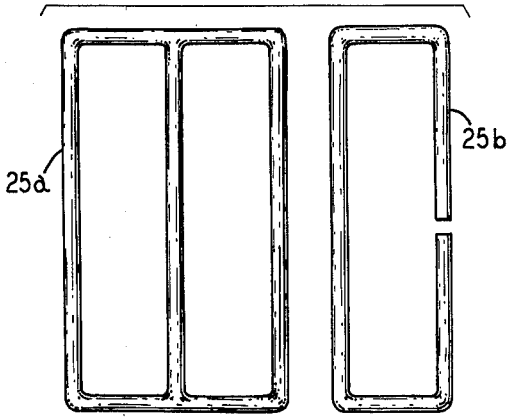

A modified form of the flush plate of the invention is shown in plan and sectional views in FIGS. 7 and 8. In the present example, the unitary flushing plate 29, which is substituted for the coupling 9–11*a* of FIGS. 1 et seq., is substantially similar in material and general rectangular shape, being of zinc coated steel about 1/16 inch thick and being substantially 3¼ inches square, with opposite lateral edges each rolled back on themselves to form flattened, cylindrical buckle retainers 31 and 32, similar to 11 and 12 of FIGS. 1 and 2. The female hose fitting 27 and the neck 27*a* on which it is rotatably supported are substantially centered in flushing plate 29, and are similar in form to hose fitting 7 and supporting neck 7a of FIGS. 1 and 2. The wire buckle assemblies 24a,24b and 25a,25b, respectively shown in FIGS. 9 and 10, are substantially similar to wire buckle assemblies 4a,4b and 5a,5b of the former embodiment, with one exception. It will be seen from FIG. 10 that buckle 25a comprises a double rectangle. This provides a better means of securing one end of the belt 13 in place, when the same is threaded through and latched at both ends in the two sets of buckles.

Figure 11:
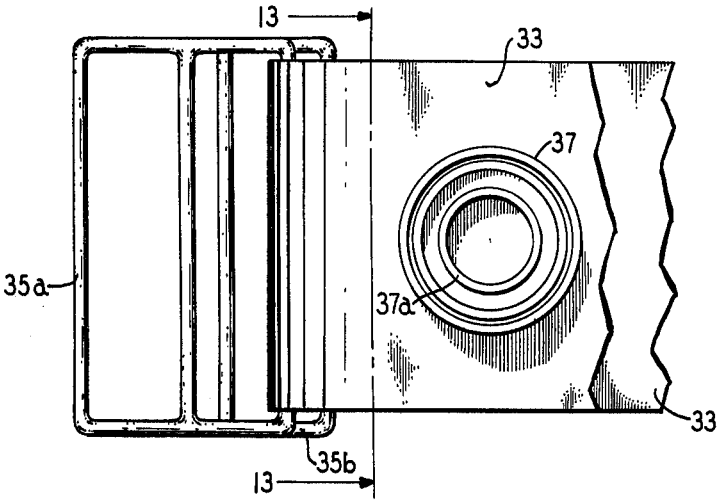
FIG. 11 shows, in plan view, a modified form of the flushing system of FIGS. 1 et seq., in which the flushing plate has been removed altogether, and the hose connection is inserted through a double-back layer near one end of the belt.
Figure 12:
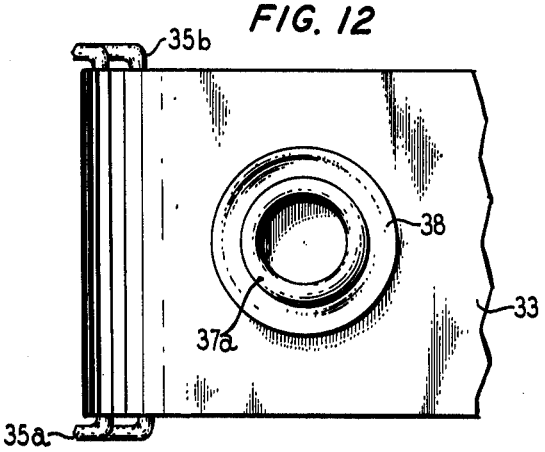
FIG. 12 shows the underside of the combination of FIG. 11.
Figure 13:
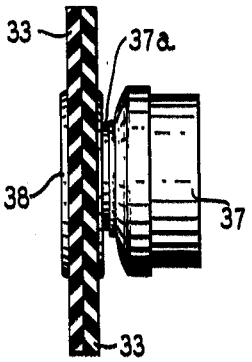
FIG. 13 shows a section through the plane 13—13 of FIG. 11.

Another embodiment of the invention is shown in top and bottom view in FIGS. 11 and 12, and in partial section in FIG. 13. In this embodiment, the metal flushing plate is omitted altogether. A belt 33, which is similar to belt 13, previously described, is folded back on itself, forming a loop at one end which acts as a retainer for the pair of wire buckles 35a,35b, similar to the pair of buckles 25a,25b, previously described, buckle 35a being a double rectangle. Centered, say, 2 inches from one end of the belt 33, is a female hose fitting 37 (similar to the female hose fitting 7 previously described). Hose fitting 37 is rotatably fastened through the double-back layer of belt 33 by means of a conventional metal grommet 37a of a type usually installed in canvas fittings, such as sails and the like, which is secured in place against a metal washer 38.

Although operation of the system has been described with reference to the motor removed from the boat or from the water, it will be understood that the system of the present invention can be operated with the motor either in or out of contact with the boat, or in or out of the water.

It will be understood that a number of variations are possible within the contemplation of the present invention; and that the invention is not limited to the specific materials, forms or shapes shown by way of example, but only by the scope of the appended claims.

What is claimed is:

1. A flushing system for outboard and sterndrive motors having an external motor housing which includes at least two water intake ports substantially spaced apart around the periphery of said housing, said system comprising:

a belt of resilient elastomer material substantially impervious to water which is constructed and arranged to wrap around and adhere to that portion of the external motor housing which includes said spaced apart water intake ports, locking means for securely fastening the two terminal portions of said belt to retain said belt in said wrap-around position, said belt including means comprising an opening constructed in said wrap-around position to register with at least one said water intake port of said housing, said means comprising an opening including a fitting for accommodating a hose terminal, wherein in said wrap-around position a portion of said belt adheres to another one of said ports and is constructed and arranged to operate as a valve flap which opens and closes in response to the waxing and waning of the pressure of water passing into said motor housing through said hose terminal.

2. The combination in accordance with claim 1 wherein said belt is of rubber or imitation rubber having a textured under surface designed to adhere to the face of said motor housing.

3. The combination in accordance with claim 1 wherein said means comprising an opening includes a flushing plate of substantially rigid solid material in which said opening including said hose terminal is substantially centered.

4. A flushing system for outboard and stern-drive motors having an external motor housing which includes at least two water intake ports substantially spaced apart around the periphery of said housing, said system comprising:

a belt of resilient elastomer material substantially impervious to water which is constructed and arranged to wrap around and adhere to that portion of the external motor housing which includes said spaced apart water intake ports, locking means for securely fastening the two terminal portions of said belt to retain said belt in said wrap-around position, said belt including means comprising an opening constructed in said wrap-around position to register with at least one said water intake port of said housing, wherein said means comprising an opening includes a flushing plate of substantially rigid solid material in which said opening including said hose terminal is substantially centered, said means comprising an opening including a fitting for accommodating a hose terminal, wherein in said wrap-around position a portion of said belt adheres to another one of said ports and is constructed and arranged to operate as a valve flap which opens and closes in response to the waxing and waning of the pressure of water passing into said motor housing through said hose terminal, and wherein said locking means comprises pairs of latching buckles rotatably mounted in retaining means on opposite edges of said flushing plate, said buckles constructed to receive and respectively secure opposite ends of said belt.

5. A flushing system for outboard and stern-drive motors having an external motor housing which includes at least two water intake ports substantially spaced apart around the periphery of said housing, said system comprising:

a belt of resilient elastomer material substantially impervious to water which is constructed and arranged to wrap around and adhere to that portion of the external motor housing which includes said spaced apart water intake ports, locking means for securely fastening the two terminal portions of said belt to retain said belt in said wrap-around position, said belt including means comprising an opening constructed in said wrap-around position to register with at least one said water intake port of said housing, wherein said means comprising an opening includes a flushing plate of substantially rigid solid material in which said opening including said hose terminal is substantially centered, said means comprising an opening including a fitting for accommodating a hose terminal, wherein in said wrap-around position a portion of said belt adheres to another one of said ports and is constructed and arranged to operate as a valve flap which opens and closes in response to the waxing and waning of the pressure of water passing into said motor housing through said hose terminal, and wherein said locking means comprise a first pair of latching buckles rotatably mounted in a first retaining means at one edge of said flushing plate, an upstanding flange at the other edge of said flushing plate, a coupling member having a slot constructed to accommodate the upstanding flange of said flushing plate, said coupling member having a second pair of latching buckles rotatably mounted in retaining means at the outside edge of said coupling member substantially parallel to said slot.

6. The combination in accordance with claim 5 wherein said coupling member has a curved upstanding flange on the other side of said slot from said pair of buckles.

7. The combination in accordance with claim 1 wherein one of the ends of said belt is fastened back on itself forming retaining means for at least one buckle comprising said locking means, and wherein said means comprising an opening includes a grommet fastened through said belt near one said end.

8. The method of flushing out an outboard or stern-drive motor which comprises the steps of:

wrapping a belt of resilient material around the lower housing of said motor so that the belt covers at least two water inlet ports interconnected at a level substantially below said motor, and spaced apart around said housing, interposing hose water through an opening in said belt directed into one of said water inlet ports, and employing said belt as a valve flap for releasing excess water from the other said water inlet port in response to an increase of water pressure in said housing.

* * * * *